United States Patent [19]

Rosenblum

[11] 4,090,002

[45] May 16, 1978

[54] REINFORCED FIBER STRUCTURES AND METHOD OF MAKING THE SAME

[76] Inventor: Jesse Rosenblum, 112 Roosevelt St., Closter, N.J. 07624

[21] Appl. No.: 351,521

[22] Filed: Apr. 16, 1973

[51] Int. Cl.[2] ..... D03D 15/02; D03D 15/06

[52] U.S. Cl. ..... 428/36; 28/140; 156/148; 156/149; 264/257; 264/278; 428/72; 428/114; 428/116; 428/117; 428/118; 428/245; 428/257; 428/258; 428/398

[58] Field of Search ..... 161/68, 69, 90, 91, 161/127, 139, 175, 178, DIG. 4; 28/76 T; 264/257, 278; 139/420 R, 390; 156/148, 149; 428/114, 36, 72, 74, 178, 188, 73, 116, 117, 118, 257, 258, 398

[56] References Cited

U.S. PATENT DOCUMENTS

| | | | |
|---|---|---|---|
| 2,426,058 | 8/1947 | Scogland | 156/148 |
| 2,454,719 | 11/1948 | Scogland | 156/155 |
| 3,221,312 | 11/1965 | MacLachlan | 139/425 R |
| 3,248,274 | 4/1966 | Karrass | 428/114 |
| 3,266,935 | 8/1966 | Boriolo | 161/139 |
| 3,312,579 | 4/1967 | Heifetz | 161/139 |
| 3,401,467 | 9/1968 | Koester | 28/76 T |
| 3,530,021 | 9/1970 | Reichl | 418/188 |

*Primary Examiner*—James J. Bell
*Attorney, Agent, or Firm*—Hubbell, Cohen, Stiefel & Gross

[57] ABSTRACT

A fiber-reinforced plastic structure is obtained by weaving fibers in one direction about one or more spacing members located angularly to the fibers. The fibers may be either warp or woof stands, the spacing member serving as woof when the fibers from warp strands, and as warp when the fibers form woof strands. The removal of the spacing member leaves relatively large open channels forming, in effect, a multi-wall hollow structure. The resultant structure may be partially or completely treated with a plastic resin system prior to or after the removal of some or all of the members. The solidified resin reinforced structure may be filled with a foam-in-place plastic, and it may be stacked in layers to provide additional thickness with reinforcing fibers running in different directions for additional strength. Some fibers may extend from one ply into an adjacent ply or into more remote plies. The hardened structure may also be stacked to provide a honeycomb configuration and may be sliced into thin sections with sheets of additional fiber-reinforced plastic material on each side or each end to produce a structure of high strength-to-weight characteristics.

25 Claims, 12 Drawing Figures

Fig. 1.
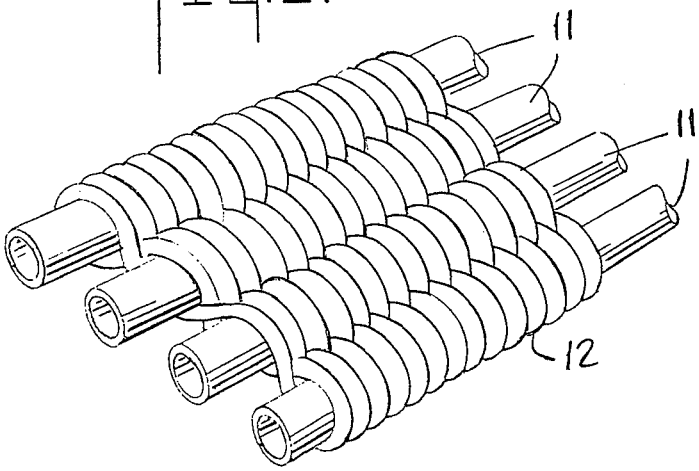
Fig. 2.
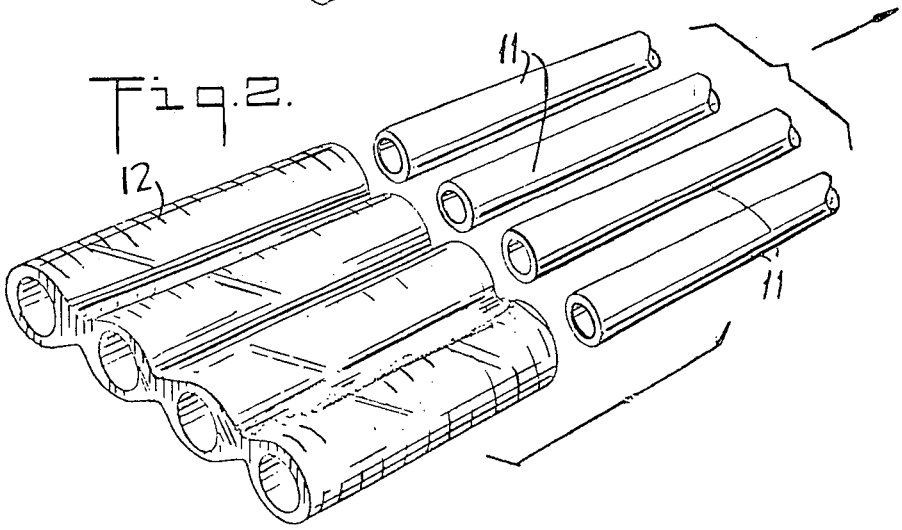
Fig. 3.
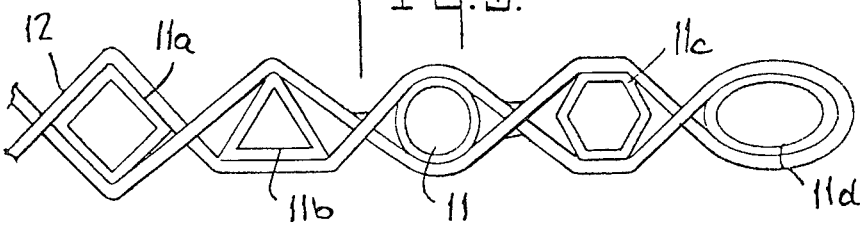
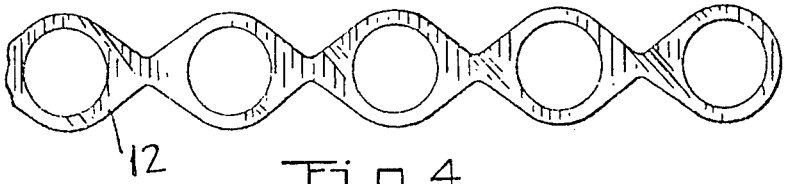
Fig. 4.

REINFORCED FIBER STRUCTURES AND METHOD OF MAKING THE SAME

BACKGROUND OF THE INVENTION

1. Field of the Invention

This invention relates to fiber-reinforced structures impregnated with plastic material and to the method of forming such structures. In particular it relates to such structures made of glass fiber in a variety of configurations and to the methods of making such structures.

2. The Prior Art

In the production of fiber-reinforced plastic structures, of which glass fiber-reinforced plastic is a well-known example, the structures have heretofore been formed by laying up bats of glass fiber and impregnating them with plastic resin or using impregnated material which is then treated so that it hardens. Instead of bats of glass fiber, such structures have also been made by draping glass fiber woven cloth over a mold and impregnating the woven cloth with resin or using pre-impregnated material. In either case the resultant structure is solid and rather thin, its thickness depending on how many layers of the glass fiber are put in place.

One object of the present invention is to increase the thickness of the woven material, which may in itself be desirable, and to increase its rigidity against bending stresses.

Another object of the present invention is to provide an improved fiber-reinforced structure in which the fibers run in one direction and define channels that extend in an angular direction.

A further object is to provide a method of forming such a structure.

Another object is to provide a fiber-reinforced structure in which the fibers run in one direction and define channels that extend in an angular direction thereto wherein at least some fibers define channels in more than one layer.

Still further objects will become apparent from the following specification together with the drawings.

BRIEF DESCRIPTION OF THE INVENTION

In accordance with the invention, a novel type of fabric is made by weaving fibers in one direction about one or more spacing members located angularly to the fibers. In one embodiment fabric is made by interlacing warp threads or members, which run the length of the woven fabric, with filling, or woof, or shute, fibers, which run the width of the fabric. Thereafter some or all of the warp members are removed, leaving primarily only the filling, or shute, fibers arranged in a configuration surrounding open channels formerly occupied by the warp members.

In another embodiment the fabric is made by interlacing woof threads or members, which run the width of the fabric, with filling or warp fibers which run the length of the woven fabric. Thereafter some or all of the woof members are removed, leaving primarily only the filling or warp fibers arranged in a configuration surrounding open channels formerly occupied by the woof members.

In another embodiment the filling fibers, whether warp or woof, extend about or are woven about removable members in more than one ply. In order to have the resultant fabric maintain its configuration, the fabric is normally impregnated with a suitable plastic resin such as polyester or epoxy material prior to removal of the warp or woof members, as the case may be, and the impregnated fibers are treated or cured to harden the resin into a self-sustaining structure before members are removed. Alternatively, in certain instances the warp members may be removed before the entire fabric is impregnated with resin by plastic foam in areas where woof fibers intersect, so that the resultant fabric can be formed according to the configuration of a mold more easily. In other instances the woof members may be removed before the entire fabric is impregnated with resin by plastic foam in areas where warp fibers intersect, so that the resultant fabric can be formed according to the configuration of a mold more easily.

BRIEF DESCRIPTION OF THE DRAWINGS

FIG. 1 is a perspective view of a fragment of partially-finished material constructed in accordance with the present invention.

FIG. 2 shows the material of FIG. 1 after plastic impregnation and after the warp members have been withdrawn.

FIG. 3 is an end view of the material in FIG. 1.

FIG. 4 is an end view of the material in FIG. 1 after plastic impregnation and after the warp members have been withdrawn.

DESCRIPTION OF THE PREFERRED EMBODIMENTS

Figure 5:
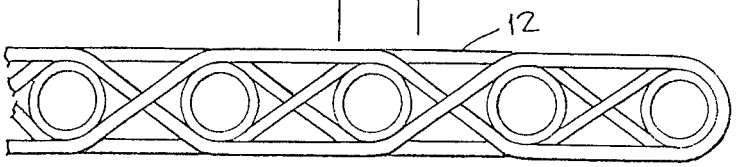
FIG. 5 is an end view of material formed with a different weave than the material in FIG. 1.

The structure in FIG. 1 may be referred to as a fabric although, due to its construction, its characteristics are quite different from the normal fabric which is pliable in all directions. The fragment of fabric shown in FIG. 1 includes warp threads, or members, as they might properly be designated, 11, which run the length of the fabric. Woven around the warp members 11 are woof, or fill, or shute threads, or fibers, 12. The only difference between the fabric as shown in FIG. 1 and normal fabric is that the warp members remain straight as they are shown here and all displacement vertical to the surface of the fabric is in the fill fibers 12. The reason for this is, that unlike the usual pliable fabric, the warp members are more or less rigid and in fact they may be in the form of paper, metal, or other types of materials that are either rigid or at least relatively rigid compared to the fill fibers due to the relative cross-sectional areas of the warp and fill members. Normally the warp members have cross-sectional areas which are considerably larger than the cross-sectional area of each of the fill fibers 12 and in actual practice each of the fill fibers 12 as shown in FIG. 1 might well be a piece of yarn made up of a large number of very fine glass fibers. Otherwise, if the fibers 12 were separate from each other and not formed into yarn, the difference in their size and the size of the warp members 11 would be even greater than the difference shown in FIG. 1.

The formation of the fabric in FIG. 1 can take place in a more or less standard fashion on a loom, provided the loom can accommodate relatively inflexible warp members of large cross-section. Alternatively, the fabric could be formed in any other suitable manner and could be formed by hand by weaving the fill fibers back and forth across the warp members 11.

FIG. 3 shows an end view of the fabric of FIG. 1 with the warp members 11 in the form of hollow tubes. As may be seen, each fill fiber goes over one warp member and under the next one and over the following one and so forth in a standard weaving pattern. Moreover, for certain purposes it may be desirable that the warp members have non-circular cross-sections, such as the square warp member 11*a* or the triangular member 11*b* or the hexagonal member 11*c* or the elongated one 11*d*.

In the production of the finished product, the next step after the fabric shown in FIGS. 1 and 3 is produced is normally to impregnate some or all of the fill fibers with a suitable plastic resin, such as polyester or epoxy material, if preimpregnated fibers, sometimes known as prepreg fibers, have not been used. The impregnated fabric is then cured to harden the resin. After the resin has been cured in accordance with the standard curing procedure for producing fiber-reinforced materials, the warp members 11 may be withdrawn, thereby leaving only the fill fibers 12 bent so that each fill fiber in this embodiment defines one side of an open loop area left at each location where a warp member 12 that intersected that fill fiber, or over (or under) which that fill fiber crossed, is withdrawn. This requires that the plastic resin not adhere to the warp members, which may be accomplished by suitable choice of the warp member material and the resin so that there is no bonding between them or it may be accomplished by dissolving the warp members in solvent which has no effect on the resin and on the fill fibers 11. In order to be certain that there is no bonding between the warp members 11 and the resin, the warp members may be coated with a suitable parting compound to which the resin will not adhere.

As a further alternative it may in some instances be desirable to leave at least some of the warp members 11 in place as conduits for liquid, gases, cables and the like, and in that case such warp members will preferably be of a material to which the resin does not bond.

FIG. 2 shows the fabric as the warp members 11 are being removed and with only the fill fibers remaining and being held in place by the resin with which they are impregnated. In this case, cavities will remain, as shown more clearly in FIG. 4, that correspond in size and shape to the warp members that have been removed. Each cavity is elongated in the direction of the warp member withdrawn from that space, but each elongated cavity is made up of incremental sections defined by the thickness of one of the fibers 12 defining one side of a loop area. The impregnated, hardened fibers 11 are self-supporting at this stage and may be used wherever a relatively thick, strong fiber-reinforced board is required. Depending upon the packing of the fibers 11 and the amount of resin used, this board may be more or less water-tight. The structure shown in FIG. 4 is self-braced by the light-weight internal fiber structure to produce an overall member of great rigidity which is much more strongly resistant to bending forces than would be the case if the same fibers 12 and 12*a* has been woven about warp members of the same cross-sectional area as the fill fibers. If desired, a thin layer of fiber-reinforced material produced by weaving in the ordinary way with both warp and woof fibers of the same size may be laid directly on both surfaces of the structure in FIG. 4 and bonded thereto to form impervious walls which can be made as liquid-tight as may be desired.

Figure 6:
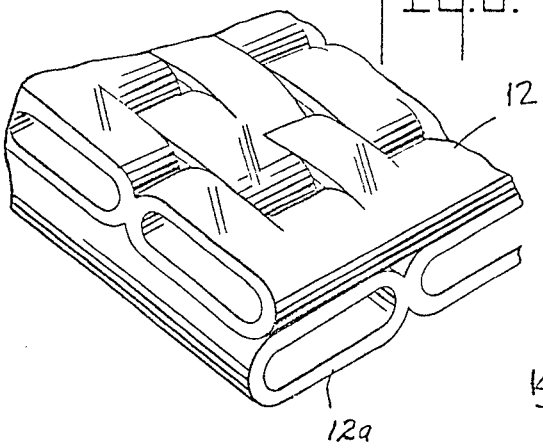
FIG. 6 shows two stacked layers of finished material woven as in FIG. 5.

The structure shown in FIGS. 5 and 6 shows the fill fibers 12 woven so that they pass across two of the warp members before changing to the other side of the fabric, but not all of the fill fibers pass between the same warp members. This weave is different from the simpler weave in FIG. 1 in which alternate fill fibers 12 passed over alternate warp members 11 and under the remaining warp members, while the remaining alternate fill fibers passed under the alternate warp member that the first set of fill fibers passed over and over the remaining alternate warp members that the first set of fill fibers passed under. In the woven structure in FIGS. 5 and 6, groups of fill fibers 12 are bent to define one side of open loop areas and, of each such group, only certain of said fibers, i.e. the end fiber of each group, lies next adjacent to a fiber in the next group that is bent to define the opposite side of the same open loop areas. The precise weave structure is not important in this embodiment; what is important is that relatively large flat areas are formed on each of the outer surfaces which become almost the equivalent of flat surfaces joined by cross-braced internal strips, producing a structure of great strength. As may be seen particularly in FIG. 5, the inner parts of the fibers 11 form triangular braces, which is what gives the whole structure its high strength. This strength is even greater in the combined arrangement in FIG. 6 in which two layers of woof fibers 12 and 12*a* woven as in FIG. 5 are bonded together with the woof fibers in one layer running in a direction perpendicular to those in the other layer.

Figure 7:
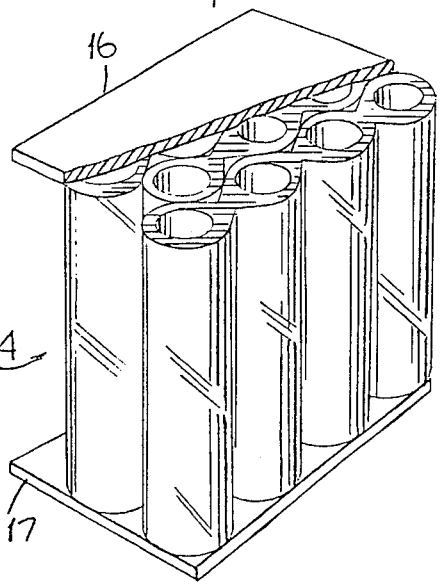
FIG. 7 shows a honeycomb arrangement of material formed according to the invention.

FIG. 7 shows a honeycomb sandwich structure constructed of short lengths of the type of fabric shown in FIG. 4, particularly if the warp members therein were of the type to nest correctly, such as those of triangular, square or hexagonal shape, and the fill fibers were stretched around them in such a way as to retain correspondingly shaped channels upon removal of the warp members. Layers of such material could then be stacked with all of the channels corresponding to the removed warp members aligned parallel to each other, to form a structure which, in its end view would have a honeycomb cellular appearance. Such a structure is indicated in FIG. 6 by reference numeral 14. The stacked woven material could be sliced into relatively thin slices before or after it was stacked so that the channels in the direction of the warp members would be relatively short. To complete the honeycomb structure and to form extremely strong but light composite structure, sheets of material 16 and 17 could be bonded to the ends of the honeycomb structure 14. The sheets could be of any suitable material including thin glass fiber-reinforced plastic which would have the advantage of being completely non-conductive and of very light weight in relation to the force required to bend such a honeycomb sandwich structure. Alternatively sheets 16 and 17 could be bonded to the front and back, or the sides, or to any opposite surfaces rather than to the ends of the honeycomb structure.

Figure 8:
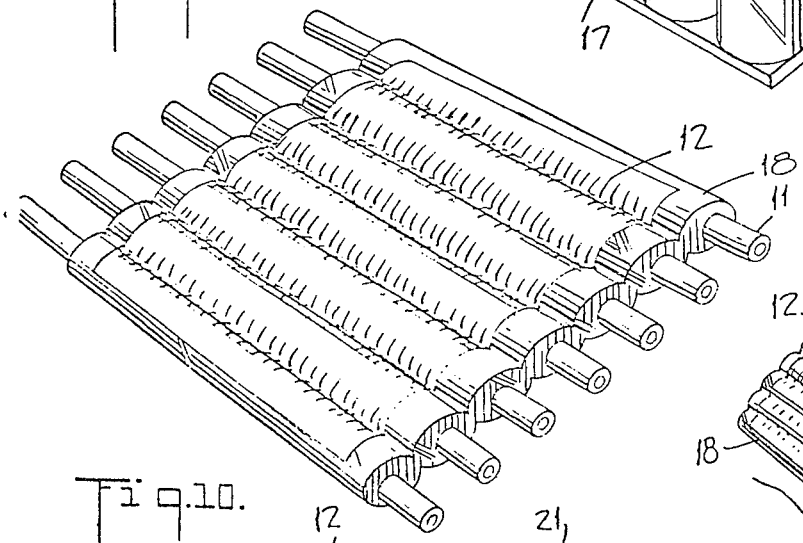
FIG. 8 shows material woven according to the invention and partially impregnated.
Figure 9:
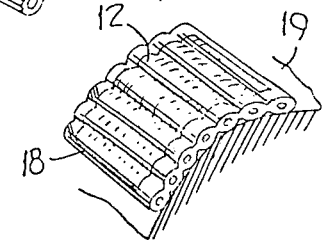
FIG. 9 shows the material of FIG. 8 shaped to fit a curved mold.

FIG. 8 shows an intermediate step in the formation of an article made in accordance with the invention. The purpose of the step carried out as illustrated in FIG. 8 is to produce a woven fiber-reinforced material of glass fiber or the like which can be shaped to fit a mold having a curved surface or a surface formed of intersecting planes. In accordance with the method depicted in FIG. 8, the woof fibers 12 are woven around the warp members 11 in any convenient pattern, the pattern illustrated here being similar to that in FIG. 1. Thereafter, instead of impregnating all of the woof fibers with plastic material, only the edge portions 18 are so impregnated. A piece of material with flexible warp members can be cut from a larger unit without disrupting the shape of the fibers 12 because of the hardened edges of the resultant mat and yet the mat will still be flexible enough to be wrapped around the curved mold as illustrated, for example, in FIG. 9. Thereafter the mat can be laid upon the curved surface of the mold 19 shown in FIG. 9 and the remainder of the fibers 12 can be impregnated with plastic material and hardened, resulting in a relatively thick fiber-reinforced structure that has the shape of the mold.

Figure 10:
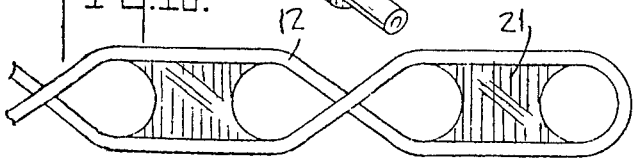
FIG. 10 shows a fragment of material formed according to the invention and partially filled with foam.

Another way of holding the fibers in place to permit them to be fitted upon the surface of a mold is illustrated in FIG. 10 in which the untreated fibers 12 are partially filled with solidified foam material 21. As may be seen, the fibers in this instance are woven so as to pass across two warp members (not shown) before passing between the warp members. This weaving configuration weaves larger cavities into which the foam material may be injected. In order to permit the resultant woven fibers 12 to be flexible enough to fit the mold, the foam material 21 should preferably be of the non-rigid type.

Figure 11:
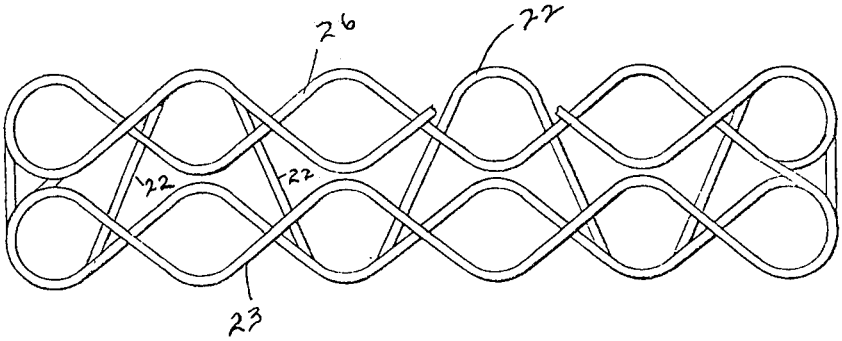
FIG. 11 is an end view of a multi-layer arrangement of material wherein some strands of fiber extend from one layer to the next.

FIG. 11 shows a multi-layer resin impregnated structure adapted for use as a support of reinforcing member. The individual plies are similar to FIG. 1. The two plies are joined by fibers 22 extending from one ply 23 to the next ply 26.

Figure 12:
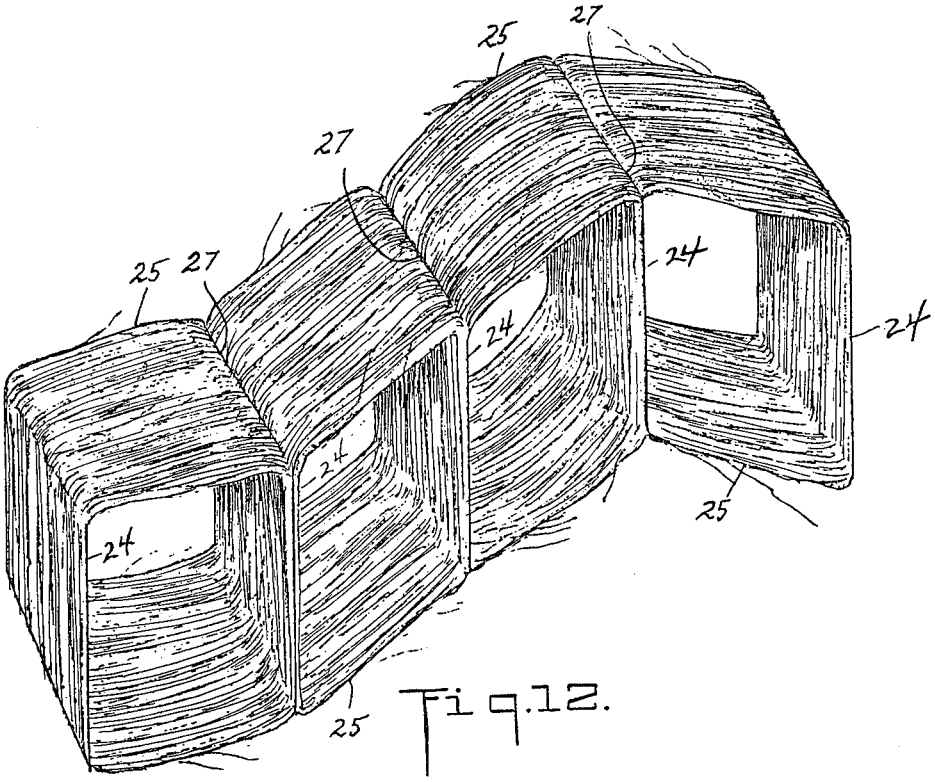
FIG. 12 is an end view of material which is resin impregnated only along its vertical strands and along the horizontal strands of the end channels to form a flexible structure capable of being expended and collapsed.

FIG. 12 shows a flexible woven structure wherein the vertically located fibers 24 are resin impregnated while the horizontally located fibers 25 are unimpregnated. This woven structure can be draped or formed on curved surfaces without collapsing. It can be shipped in a flattened condition and will spring back when the restraining force is released.

The open loop areas in any of the woven fabric of the present invention may, if desired, be filled with any suitable filler material such as, for example, balsa wood, expanded plastic foam, chopped glass, clay, mica, wood flour. The filled material may be pressure molded.

The woven fabric of the present invention may be blow molded by employing an inflatable or expandable member as the removable member.

While the invention has been described with particular reference to fill fibers which are woven around removable warp members, it is to be understood that the fill fibers may be woven around removable woof members.

While this invention has been described in terms of a limited number of embodiments, it will be obvious to those skilled in the art of weaving that a great many other configurations are possible and that the invention is not to be considered as being limited to the embodiment shown.

The structures of the present invention are useful as structural members, support members, and reinforcing members. They are useful as cushioning members and as shock absorbing members. They are useful as packaging inserts and as space filling members.

While this invention has been described in some detail, it will be understood by those skilled in the art that variations and modifications may be made without departing from the spirit thereof or the scope of the following claims.

What I claim is:

1. A structural member comprising: a solidified cured synthetic resin portion and a fibrous reinforcement comprising elongated fibers embedded in said resin portion and bent into the configuration of, and extending in the direction of, either warp or woof fibers, but not both, of a woven fabric, certain of said fibers being bent to define one side of open loop areas, each of said areas having a size and shape determined by the size and shape of the missing woof or warp strands, respectively, of said fabric, and the next adjacent fiber on at least one side of said certain fibers being bent to define the opposite side of at least selected ones of said open loop areas.

2. A non-woven structural member comprising: a fibrous material containing undirectional fibers bent only as warp or woof fibers, but not both, and having at least one open loop area located at an angle relative to the direction of the fibers, at least certain of said fibers being bent to define one side of said loop area and the next adjacent fibers on one side of said certain fibers being bent to define the opposite side of said loop area, at least some portions of the fibrous material being rigidified by impregnation with a resin and completely cured.

3. A member according to claim 2 comprising a plurality of plies and having a plurality of loops wherein at least some fibers extend from a loop area in one ply to a loop area in a different ply.

4. A member according to claim 2 wherein substantially all of the fibers are rigidified by impregnation with a resin and completely cured.

5. A member according to claim 4 comprising a plurality of plies wherein at least some fibers extend from a loop area in one ply to a loop area in a different ply.

6. A member according to claim 2 wherein the rigidified portions of the fibrous material are arranged in a discontinuous pattern whereby portions of at least some loops are not impregnated, thereby imparting a degree of flexibility to the member.

7. A structural member according to claim 1 wherein a plurality of solidified portions having fibrous reinforcement embedded therein are superimposed in layers.

8. A member according to claim 7 wherein the fibers of each layer are disposed at an angle to the fibers in each adjacent layer.

9. The structural member of claim 1 in which said fibers define loop areas having larger cross sections than said fibers.

10. The structural member of claim 1 in which said fibers define adjacent loop areas arranged in straight-line alignment.

11. The structural member of claim 1 in which said fibers define passageways through said member.

12. The structural member of claim 1 in which said loop areas contain solidified plastic foam.

13. The structural member of claim 1 in which said resin is only on the periphery of said loop areas.

14. A structural member comprising: first and second sheets of glass fiber-reinforced solid, cured synthetic resin; and a glass fiber-reinforced, cured synthetic resin central structure adhesively joined to both said first sheet and said second sheet, said central structure comprising a series of layers of glass fiber fill strands formed in woven pattern and certain of said strands defining one side of open loops corresponding to warp strands woven with said fill strands and others of said strands adjacent said certain strands defining the opposite side of said loops.

15. A non-woven article of manufacture comprising: a plurality of substantially only fill fibers in a pattern defining channels substantially perpendicular to said fill fibers and of substantially greater cross-sectional area then the cross-sectional area of said fill fibers certain ones of said fill fibers being bent to define only one side of at least selected ones of said channels, and the next adjacent fill fibers on at least one side of said certain fill fibers being bent to define only the opposite side of said selected channels; and cured plastic resin impregnated into selected areas of said fibers to fix the arrangement of said fibers in said areas.

16. The article of claim 15 in which said areas define a periphery of said pattern.

17. The article of claim 15 comprising a hollow tubular warp member in one of said channels.

18. The article of claim 17 in which said warp member is flexible.

19. The article of manufacture of claim 15 in which said layers of the woven fill fibers are stacked together with all of said channels aligned parallel to each other and in interlocking relationship whereby the end of the resultant structure has a honeycomb configuration, said article comprising, in addition, first and second plates bonded to opposite surfaces of the honeycomb structure.

20. The article of manufacture of claim 19 in which said channels are of similar and nesting cross-section.

21. The article of manufacture of claim 20 in which said channels are triangular.

22. The article of manufacture of claim 20 in which said channels are square.

23. The article of manufacture of claim 20 in which said channels are hexagonal.

24. The article of claim 19 in which said plates are substantially flat and are made of solidified, glass fiber-reinforced resin.

25. The article of claim 15 comprising a multiplicity of layers of said fill fibers in woven pattern with the fill fibers in alternate layers extending substantially perpendicularly to each other and said layers bonded together.

* * * * *